US011219293B2

(12) United States Patent
Correnti

(10) Patent No.: US 11,219,293 B2
(45) Date of Patent: Jan. 11, 2022

(54) EXFOLIATING AND NOURISHING APPLICATOR

(71) Applicant: Sonia Correnti, East Rockaway, NY (US)

(72) Inventor: Sonia Correnti, East Rockaway, NY (US)

(73) Assignee: Soniagenix, Lynbrook, NY (US)

( * ) Notice: Subject to any disclaimer, the term of this patent is extended or adjusted under 35 U.S.C. 154(b) by 0 days.

(21) Appl. No.: 16/783,876

(22) Filed: Feb. 6, 2020

(65) Prior Publication Data

US 2020/0245742 A1 Aug. 6, 2020

Related U.S. Application Data

(60) Provisional application No. 62/801,749, filed on Feb. 6, 2019.

(51) Int. Cl.
*A45D 34/04* (2006.01)

(52) U.S. Cl.
CPC ..... *A45D 34/042* (2013.01); *A45D 2200/055* (2013.01); *A45D 2200/1054* (2013.01); *A45D 2200/1081* (2013.01)

(58) Field of Classification Search
CPC ..... A45D 34/042; A45D 2200/1054; A45D 2200/055; A45D 2200/1081; A45D 2200/054; A45D 2200/10; A45D 2200/1009; A45D 2200/1018; A45D 2200/1027; B05C 17/00586; B05C 17/00506; B05C 17/00509; B05C 17/00513; A46B 11/001; A46B 11/002; A46B 11/0024; A46B 11/0027; A46B 11/0062; A46B 11/0065; A46B 11/0075; B65D 83/0005; B65D 83/0011; B65D 83/0022
USPC ..... 401/6, 37, 38
See application file for complete search history.

(56) References Cited

U.S. PATENT DOCUMENTS 1,060,524 A * 4/1913 Wolfe ..... A46B 11/0041 401/39
6,190,173 B1 * 2/2001 Jenkins ..... G09B 5/04 434/167
6,530,707 B1 * 3/2003 Byrne ..... A45D 34/04 401/176

(Continued)

*Primary Examiner* — David J Walczak
(74) *Attorney, Agent, or Firm* — Dunlap Bennett & Ludwig, PLLC; Brendan E. Squire

(57) ABSTRACT

A disposable dual-ended aesthetic device—the "SkinSweep Wand", features an exfoliating bristle brush, which may be treated with Baobab oil, which is ergonomically designed to gently exfoliate the dermis of the face and neck. An applicator head is provided for dispensing a nourishing topical liquid/serum specially formulated to nourish and reinvigorate the freshly-exfoliated skin. The device further comprises a unitary body, ergonomically designed for ease of use and comfort, which incorporates a vial section comprising a void dimensioned to contain a unit dose of the nourishing topical liquid/serum. The multi-functioned device is comprised of lightweight but rigid materials (e.g. plastic) that allow an individual to efficiently use the device to exfoliate, nourish and invigorate the dermis of their face and neck. Upon completion of the exfoliation and application of the liquid/serum the device is rendered readily disposable.

6 Claims, 8 Drawing Sheets

(56) References Cited

U.S. PATENT DOCUMENTS 8,967,898 B1 * 3/2015 Dayeh ..... A47K 7/028
401/188 R

* cited by examiner

EXFOLIATING AND NOURISHING APPLICATOR

CROSS-REFERENCE TO RELATED APPLICATION

This application claims the benefit of priority of U.S. provisional application No. 62/801,749, filed Feb. 6, 2019, the contents of which are herein incorporated by reference.

BACKGROUND OF THE INVENTION

The present application is directed, generally, to exfoliation devices, skin conditioning and nourishment applicators.

Exfoliation devices, skin conditioners and nourishment formulas are available in a wide variety of permutations. Exfoliation plays an important part in maintaining the health and happiness of the skin for a number of reasons. Stimulating the skin through exfoliation stimulates the production of collagen and, increases blood flow to the area, which encourages cell turnover to reveal a glowing and healthy-looking complexion. Exfoliation is also an essential part of keeping pores clean, clear and unclogged, which is especially needed among those with acne-prone skin.

Current exfoliating devices for the face and neck are electronic in nature and non-disposable. As a result, if used improperly, over-exfoliation can occur, leading to damage to the dermis. Also, it invariable happens that after several uses, bacteria tends to accumulate onto these devices, resulting in a time-consuming cleaning problem, which, if not done properly, can lead to the reintroduction of bacteremia causing adverse reactions. A disposable exfoliating device is therefore desirable.

In addition, although skin nourishment solutions are available in a wide variety of packages, including bottles, jars, tubes and cans, there are relatively few on the market that include built-in applicators wherein a liquid/serum flows through the applicator to an applicator surface. Most, particularly lotions, are traditionally dispensed out of a container into the hand, a sponge, or some other stand-alone applicator and then applied to the desired bodily surface. Such application methods may be unsanitary, wasteful and/or messy, and may lead to undesirable post-application cleaning (e.g., hand washing or applicator rinsing).

As can be seen, there is a need for an improved exfoliation device, which provides for manual exfoliation and the application of a topical skin nourishment liquid/serum.

SUMMARY OF THE INVENTION

In one aspect of the present invention, an aesthetic applicator is disclosed. The aesthetic applicator includes an exfoliation segment having an elongate shaft and an exfoliating tip disposed at a distal end of the elongate shaft. A topical serum applicator segment is disposed at an opposite end of the exfoliating segment. The topical serum applicator segment having a reservoir disposed at a proximal end. A serum delivery shaft interconnects the reservoir with an applicator head disposed at a distal end of the serum delivery shaft. A channel is defined within the serum delivery shaft and is in fluid communication with the reservoir and the applicator head.

In some embodiments, the exfoliating tip is an exfoliating bristle brush.

In other embodiments, a proximal end of the elongate shaft is received within the reservoir. A ring is attached to the proximal end of the elongate shaft such that the ring is dimensioned to engage with an inner surface of the reservoir.

In some embodiments, the exfoliation segment is movable relative to the serum applicator segment, such that the ring is configured to urge a serum contained within the reservoir to the applicator head via communication through the channel. In other embodiments, a predetermined volume of a topical serum contained within the reservoir. In a preferred embodiment, the serum is Baobab oil.

In some embodiments, a frangible seal is disposed between the reservoir and the channel.

In other embodiments, the reservoir is resiliently deformable and is configured to urge a serum contained within the reservoir to the applicator head via communication through the channel. The reservoir may also contain a predetermined volume of a topical serum contained within the reservoir. The topical serum is preferably Baobab oil.

In some embodiments, the applicator head is a cylindrical body. In yet other embodiments, the applicator head is a wedge shaped body.

In other aspects of the invention, an aesthetic applicator includes an elongate handle at a first end of the aesthetic applicator. An exfoliating applicator end is removably coupled to the elongate handle. A head is disposed at a distal end of the aesthetic applicator. The head has an applicator face and an exfoliating face on an opposite side of the head. A reservoir is configured to contain a volume of a serum therein. The reservoir is in fluid communication with the applicator face.

In some embodiments, a piston is moveably carried within the reservoir. A shaft is carried within the elongate handle and is operable for urging the piston to dispense the serum to the applicator face.

In other embodiments, coupling is provided at a distal end of the reservoir. A channel shaft is provided at a proximal end of the head. The channel shaft has an interior channel for communication of the serum to the applicator face.

In other embodiments, a cartridge containing a quantity of serum is received within the reservoir.

In yet other embodiments, a frangible seal is disposed between the reservoir and the head. The frangible seal may be ruptured by pressurization of the serum contained within the reservoir.

These and other features, aspects and advantages of the present invention will become better understood with reference to the following drawings, description and claims.

BRIEF DESCRIPTION OF THE DRAWINGS

Having thus described the invention in general terms, reference will now be made to the accompanying drawings, which are not necessarily drawn to scale.

Figure 1:
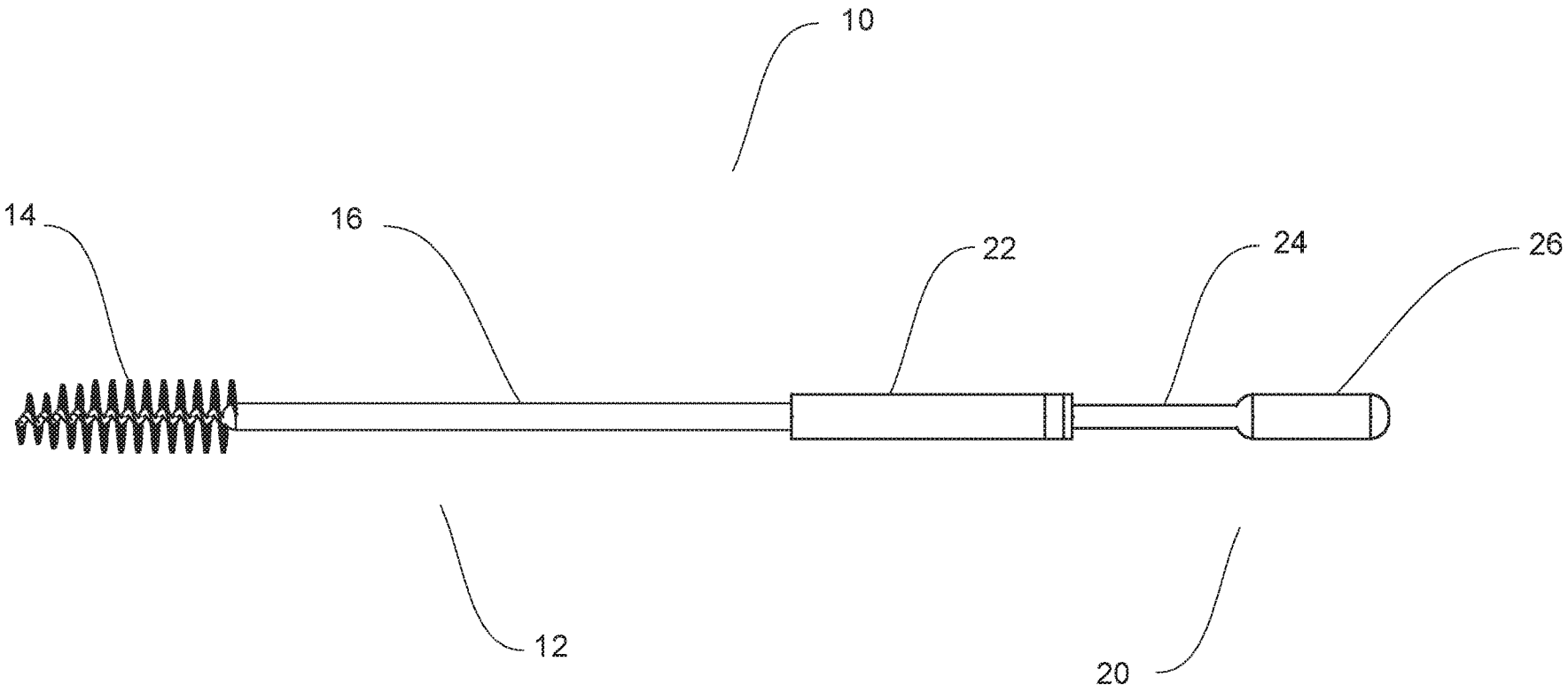
Figure 2:
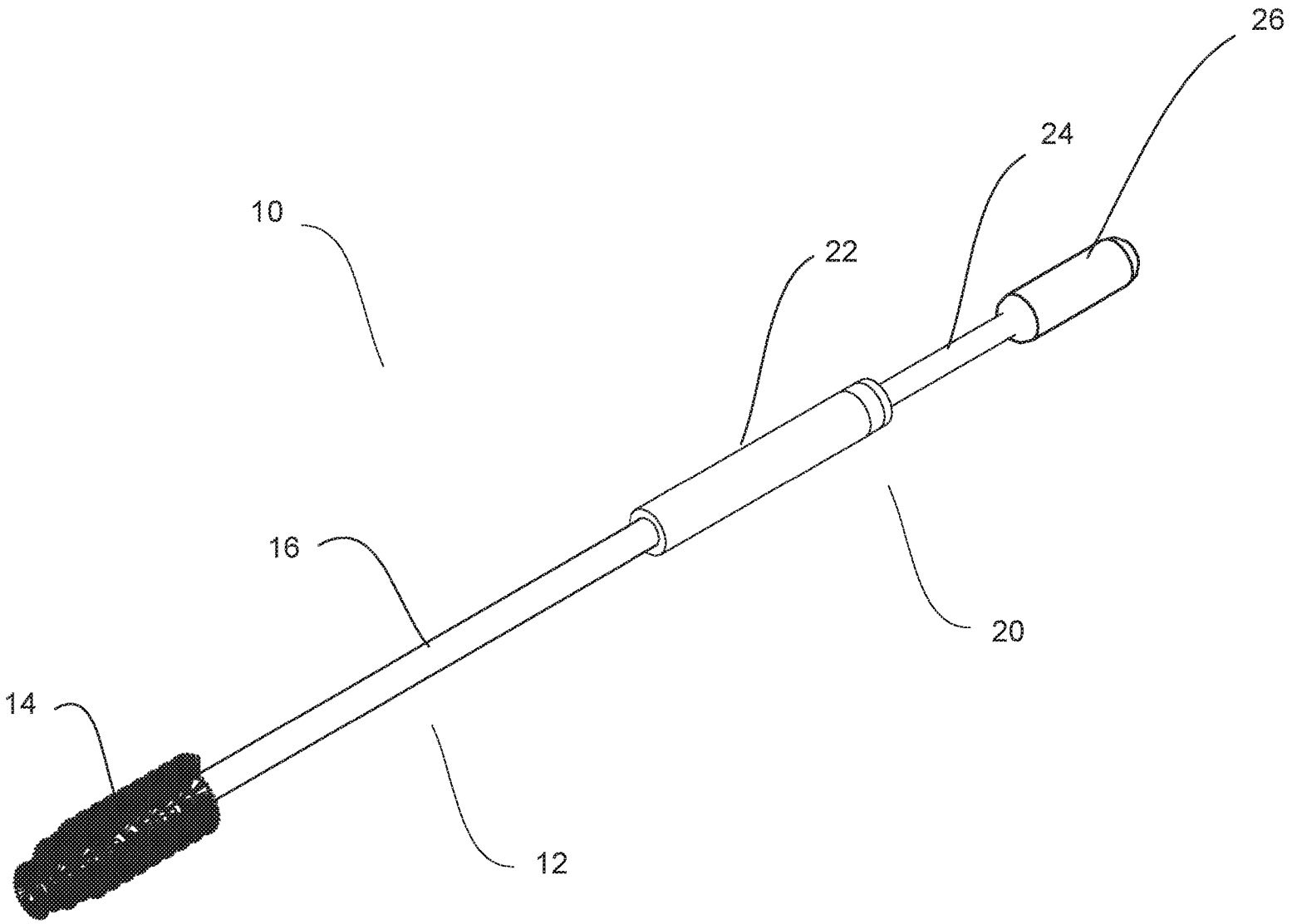
Figure 3:
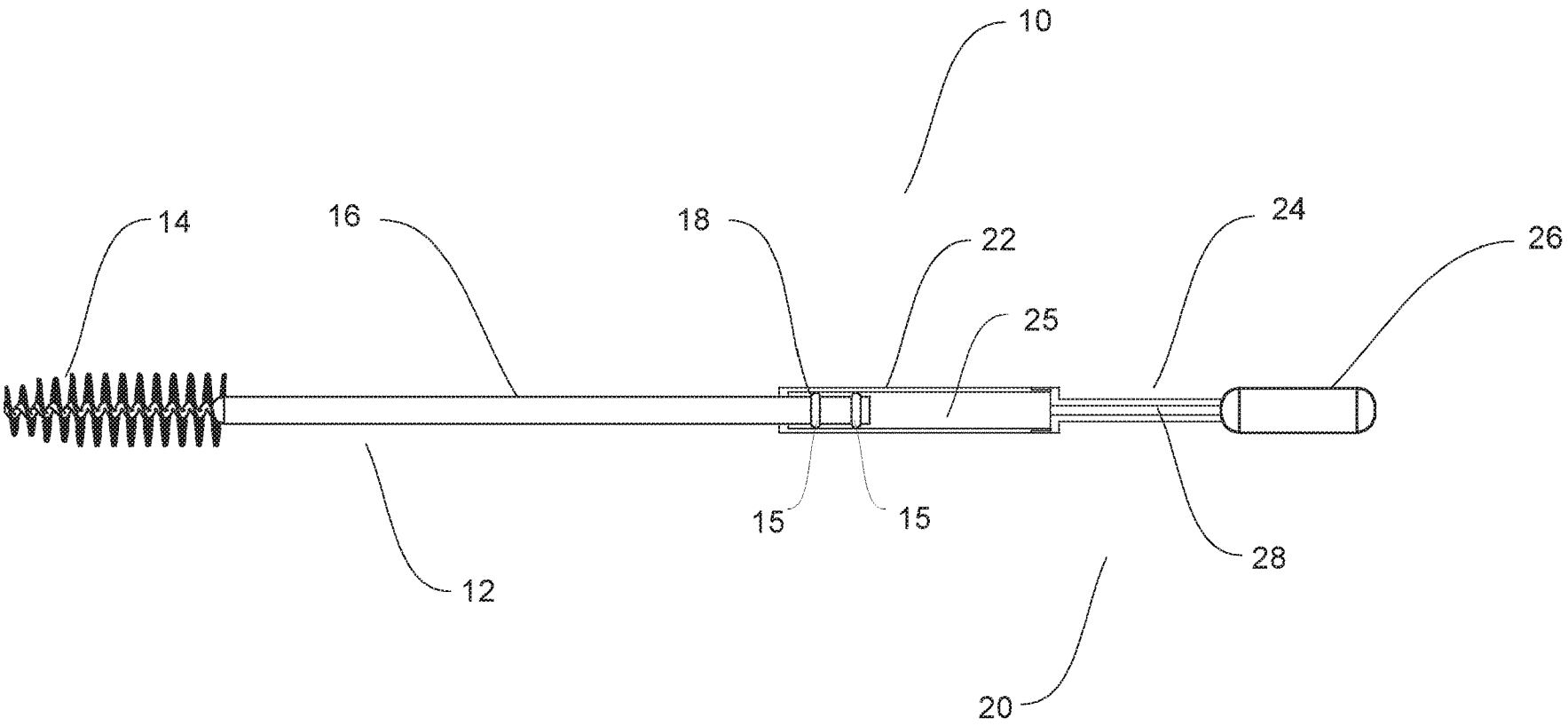
Figure 4:
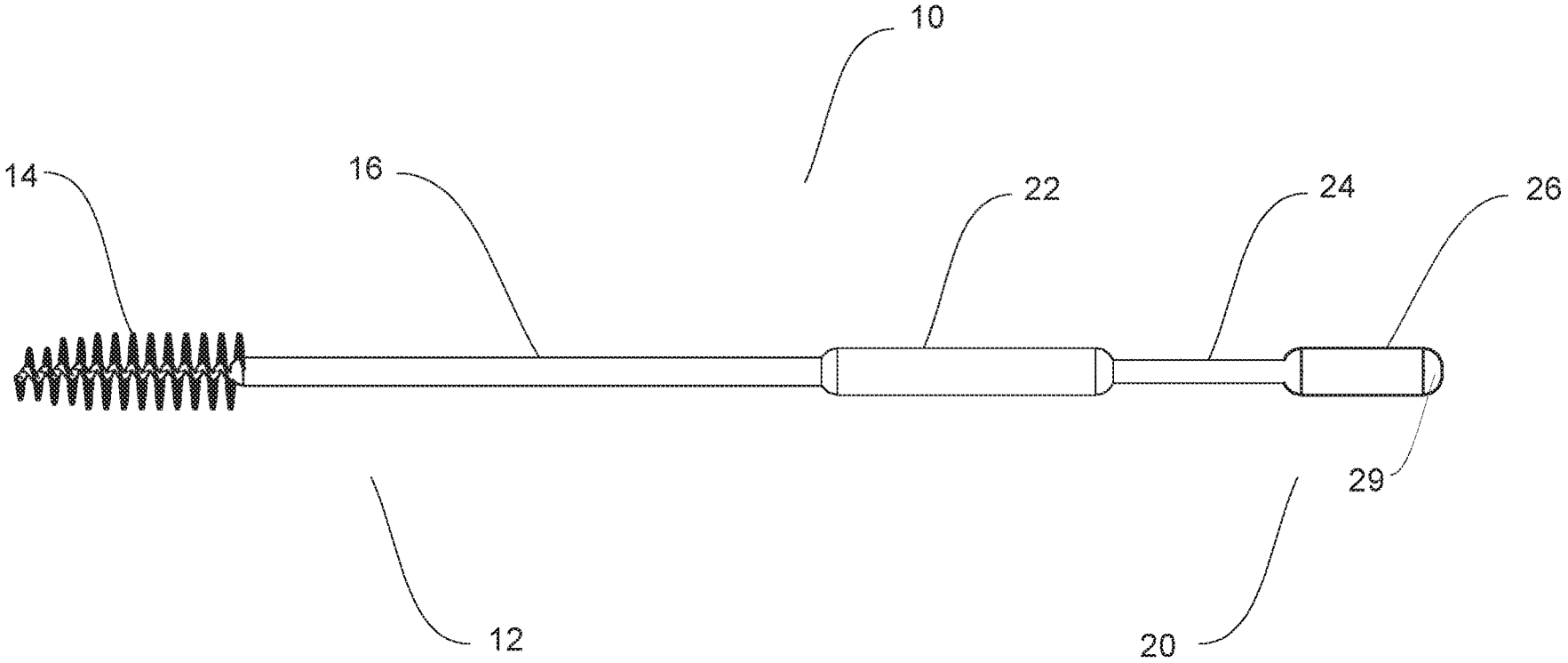
Figure 5:
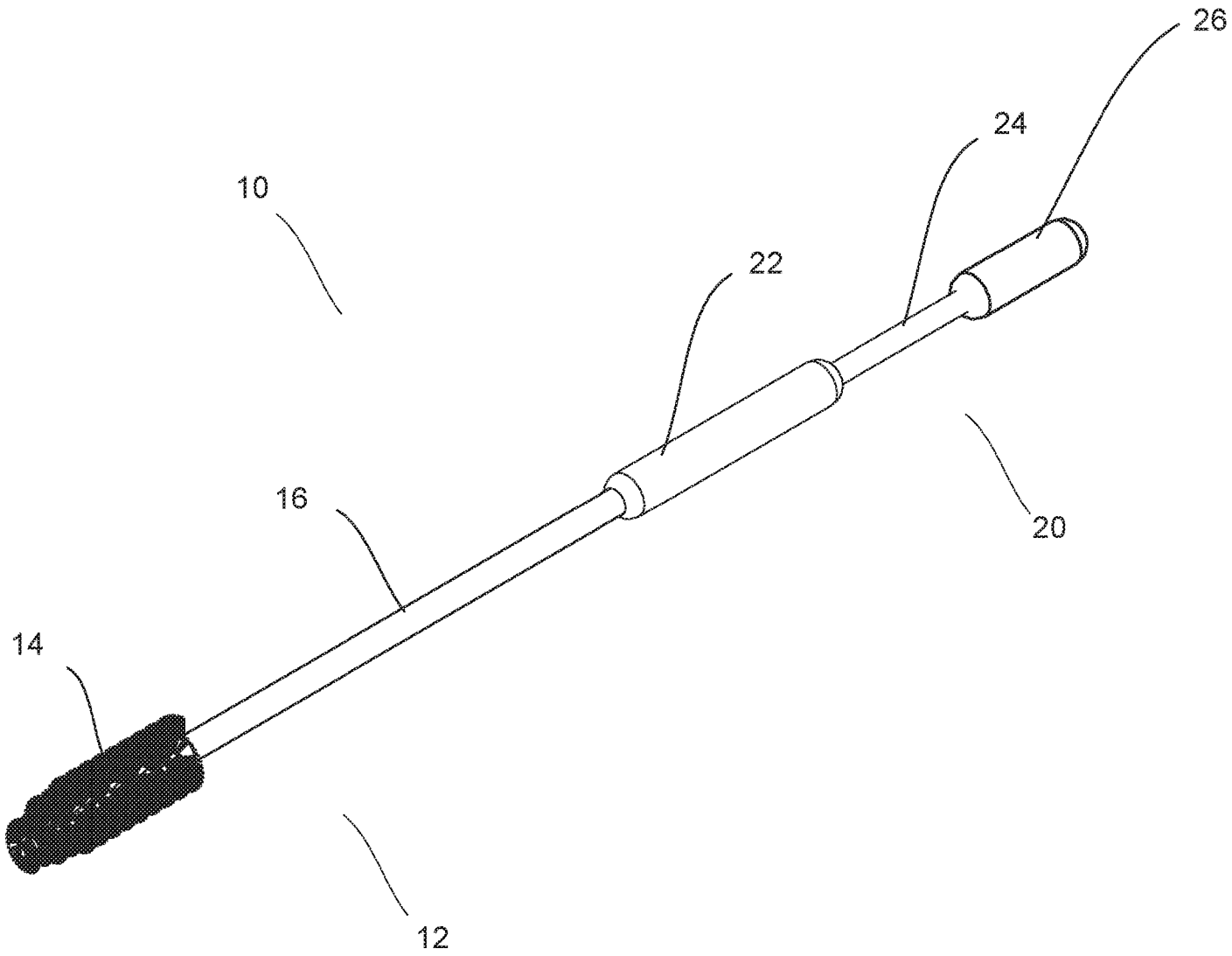
Figure 6:
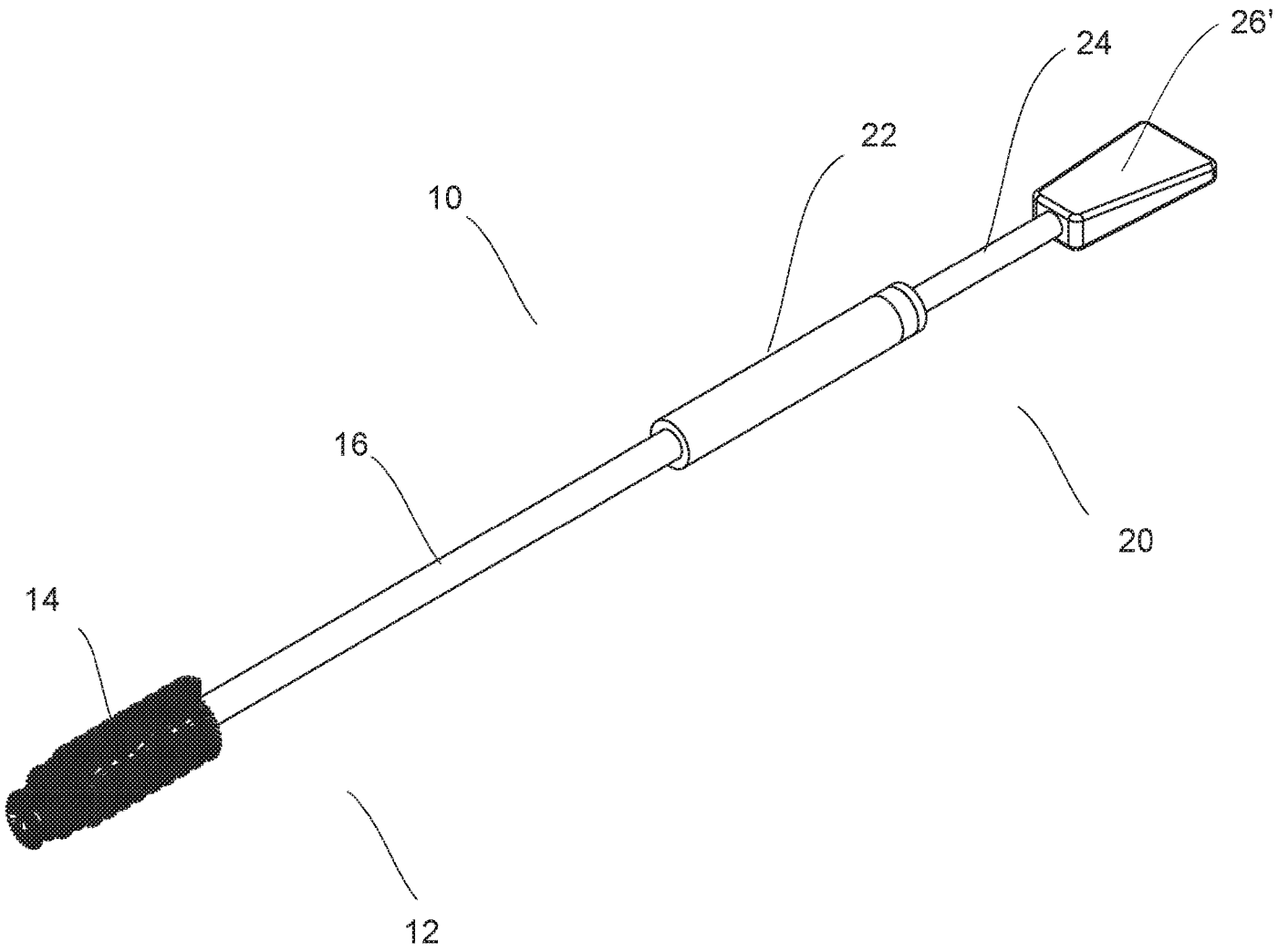
Figure 7:
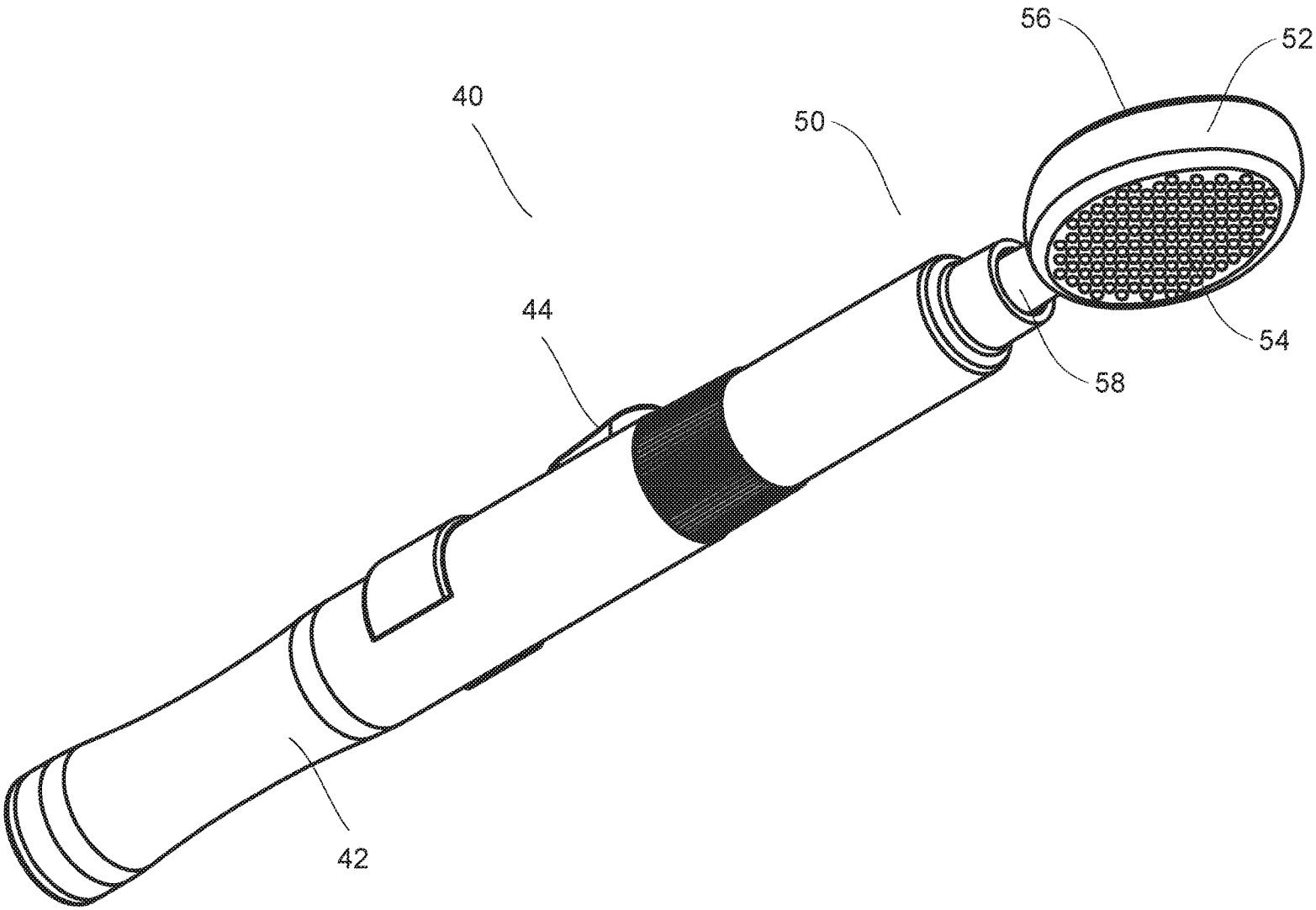
Figure 8:
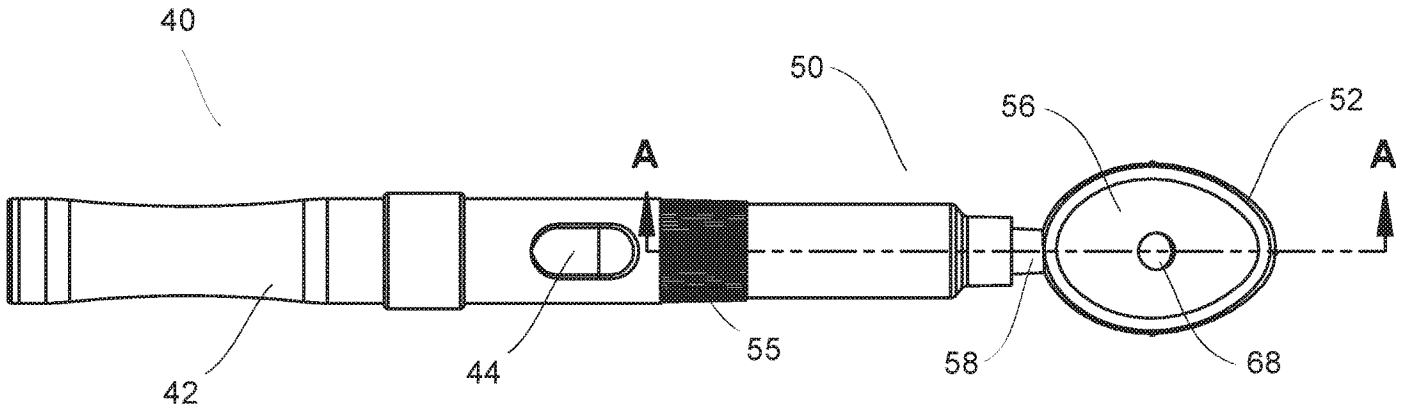
Figure 9:
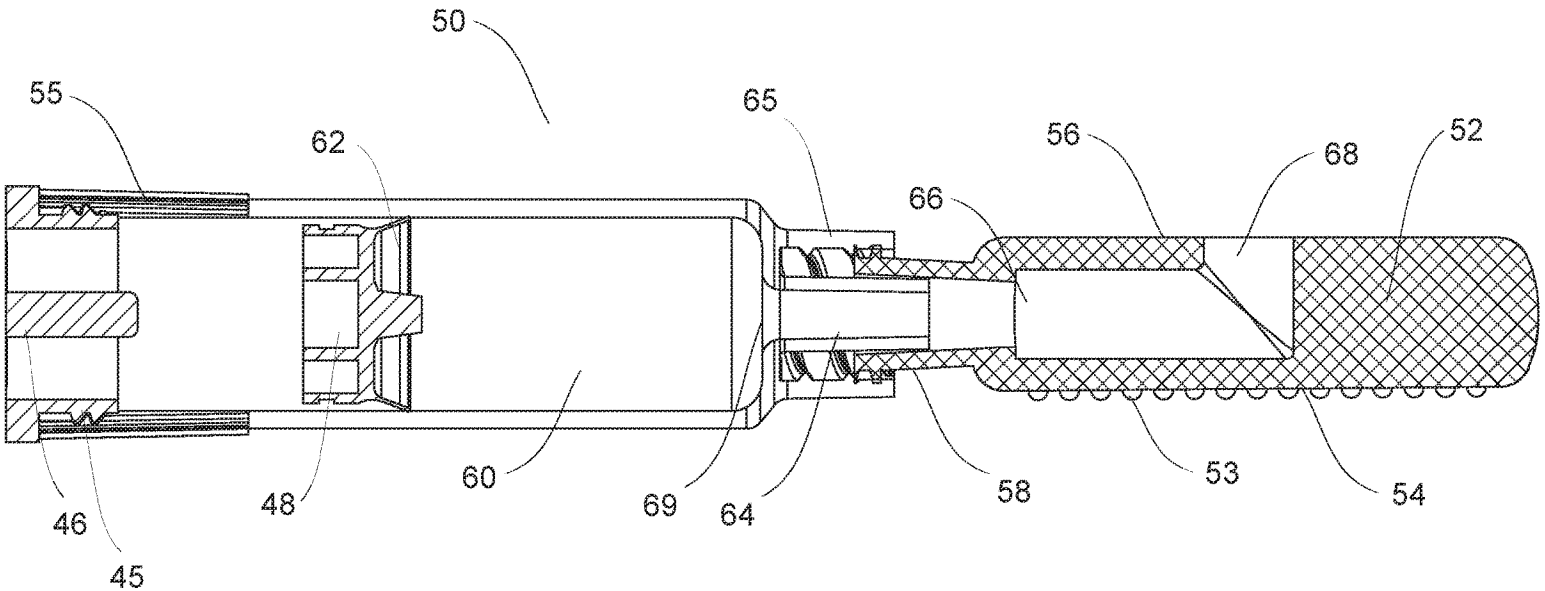

FIG. 1 is a side elevational view of a aesthetic applicator, according to aspects of the invention;

FIG. 2 is a perspective view of the aesthetic applicator;

FIG. 3 is a partial sectional view of the aesthetic applicator;

FIG. 4 is a side elevational view of the aesthetic applicator;

FIG. 5 is a perspective view of the aesthetic applicator with a squeezable liquid/serum reservoir;

FIG. 6 is a perspective view of the aesthetic applicator with a wedge-shaped applicator head;

FIG. 7 is a perspective view of an alternative embodiment of an aesthetic applicator;

FIG. 8 is a top plan view of the alternative embodiment of the aesthetic applicator; and FIG. 9 is a sectional view of the aesthetic applicator taken along line A-A of FIG. 8.

The novel features which are characteristic of the invention, as to organization and method of use, together with further objects and advantages thereof, will be better understood from the following disclosure considered in connection with the accompanying drawings in which one or more preferred embodiments of the invention are illustrated by way of example. It is to be expressly understood, however, that the drawings are for the purpose of illustration and description only and are not intended as a definition of the limits of the invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provides a system method and apparatus for an exfoliating and topical skin nourishing applicator device. The device may be utilized for both exfoliating the skin and for applying a topical nourishing liquid/serum to the skin. In some aspects of the invention, a First-In-Its Class disposable dual-use aesthetic apparatus—referred to as the "SkinSweep Wand"—is disclosed. The aesthetic apparatus is designed to exfoliate, nourish and then reinvigorate the dermis of the skin and neck by the application of a specially-formulated nourishing topical liquid/serum, such as Baobab oil.

As seen in reference to FIGS. 1-6 non-limiting embodiments of a disposable dual-use exfoliation and topical nourishing liquid/serum aesthetic applicator device 10 are shown. FIG. 1 is a side elevational view of the SkinSweep Wand aesthetic applicator 10. The aesthetic applicator 10 includes an exfoliation segment 12 at a first end and a topical nourishing liquid/serum applicator segment 20 disposed at an opposite end.

The exfoliation segment 12 may include: an exfoliating bristle brush 14 disposed at a distal end of an elongate shaft 16. The applicator segment 20 includes a reservoir 22 disposed at a proximal end and a serum delivery shaft 24 interconnects the reservoir 22 with an applicator head 26 disposed at a distal end of the serum delivery shaft 24. A channel 28 is defined within the serum delivery shaft 24 and is in fluid communication with an interior cavity 25 of the topical serum reservoir 22 and the applicator head 26. FIG. 2 shows a rear perspective view of the SkinSweep Wand 10, illustrating the exfoliating bristle brush 14, topical liquid/serum reservoir 22, the serum delivery shaft 24 and the applicator head 26.

FIG. 3 is a partial side sectional view of the aesthetic applicator 10. The proximal end 18 of the elongate shaft 16 is carried within the interior cavity 25 of the reservoir 22. The proximal end 18 is fitted with one or more piston rings 15 dimensioned to sealingly engage with an inner surface of the interior cavity 25, defining a piston. The piston is movable within the interior cavity 25 and is configured to urge a volume of topical serum through the channel 28 of the serum delivery shaft 24. The channel 28 is in communication with a surface of the applicator head 26.

FIG. 4 is a side elevational view of an alternative embodiment of the SkinSweep Wand 10 illustrating the exfoliating bristle brush 14 disposed at a distal end of an elongate shaft 16. A proximal end of the elongate shaft 16 is connected to a first end of a squeezable serum reservoir 22 having an interior cavity 25 to contain a predetermined volume of a serum. A second end of the serum reservoir 22 is in fluid communication with a serum channel 28 carried within the serum delivery shaft 24 and the applicator head 26. In this embodiment, squeezing the reservoir 22 applies a pressure to the volume of serum contained within the serum reservoir 22. The pressure urges the serum through the channel 28 for delivery to one of the applicator head 26. In some embodiments, the channel 28 may be configured to communicate the serum to a tip 29 of the applicator head 26, rather than more broadly to the applicator head 26. This embodiment can be advantageous for a more targeted delivery of the serum to the dermis.

FIG. 5 shows a rear perspective view of the SkinSweep Wand 10 illustrating the exfoliating bristle brush 14, elongate shaft 16, squeezable topical liquid/serum container, liquid/serum channel and, applicator head. FIG. 6 shows details of the SkinSweep Wand illustrating the exfoliating bristle brush, depressing piston, topical liquid/serum container, liquid/serum channel and applicator head in a wedge-shaped configuration. Preferably, the device is fabricated as a disposable device.

In the non-limiting embodiments shown, the aesthetic applicator 10 includes a generally cylindrical body approximately four inches in length and ⅜ of an inch in width, which is ergonomically designed for ease of use and comfort. The aesthetic applicator 10 has a first aesthetic instrument 14 and a second aesthetic instrument 26 disposed on opposite ends of the aesthetic applicator 10. The first instrument may include an exfoliating bristle brush 14, approximately one inch in length by ⅜ of an inch in circumference. At the opposite end, the second instrument may include an applicator head 26, which may be approximately one inch in length by ⅛ of an inch in width.

The applicator head 26 is preferably formed of a sponge-like material for dispensing a specially-formulated topical skin nourishing liquid/serum. The exfoliating bristle brush 14 has a plurality of bristles, which may be formed of a nylon and/or a polyester, and may also be treated with a liquid/serum, which, by way of non-limiting example, may include Baobab Oil.

The first instrument 14, is carried on a cylindrical shaft 16, a proximal end of which is connected with a first end of a cylindrical reservoir 22. The cylindrical shaft 16 may include one or more rings 15 that sealingly engage with an interior surface of the cylindrical reservoir 22, to form a piston. A hollow shaft 24 extends between a second end of the cylindrical reservoir 22, such that an interior channel 28 of the hollow shaft 24 is in fluid communication with the applicator tip 26, disposed at a distal end thereof. The cylindrical reservoir 22 is dimensioned to contain a predetermined volume of topical liquid/serum, which may be communicated to the applicator head 26 by urging the piston into the cylindrical reservoir 22.

In a non-limiting example, the cylindrical reservoir 22 may contain approximately one to three ML of the specially formulated topical liquid/serum, which then dispenses the topical liquid/serum via the interior channel 28 to the applicator head 26. The applicator head 26, may be formed in a desired shape, such as a rectangular or a wedge-shaped configuration approximately one inch in length by ⅛ of an inch wide. One of the cylindrical reservoir 22 or the hollow shaft 24, may also include a frangible seal, such as a membrane, for containment of the liquid/serum within the reservoir 22 prior to use. The frangible seal may be readily opened upon pressurization of the cylindrical reservoir 22 by actuation of the piston 15, or squeezing the reservoir 22.

The aesthetic applicator 10 may, be molded of a hard durable and a rigid or semi-rigid plastic material, depending on its intended use. For example, in some embodiments, the entire body may be comprised of a suitable medical grade plastic having sufficient strength and rigidity, such as a Shore D rigid and hard plastic of a sufficient durometer to withstand the normal, tensile, tangential and other forces used when handling the apparatus during its use. The body may also include a semi-rigid structure to limit the abrasion and consequent exfoliation, for sensitive skin areas.

The aesthetic applicator 10 is well suited for cosmetic and dermatological uses, as described herein. Though it may find broader use as an applicator, with a surface preparation end 12 and a liquid dispensing and application end 20. Accordingly, it should be appreciated that the present invention, in providing an inexpensive, disposable aesthetic applicator 10 having integrally formed attachments on either end greatly reduces cost and waste.

An alternative embodiment of the aesthetic applicator 40 is shown in reference to FIGS. 7-9. The aesthetic applicator 40 includes an elongate handle 42 at a first end and an exfoliating applicator end 50 attached to the elongate handle 42 at a distal end thereof. The handle 42 includes a serum delivery button 44 that is operable to selectively position a serum delivery shaft 46 within the elongate handle 42. A distal end of the elongate handle 42 may include a coupling 45, such as a plurality of threads, for cooperative engagement with a coupling sleeve 55 disposed at a proximal end of the exfoliating applicator end 50.

The exfoliating applicator end 50 has a head 52 at a distal end thereof. The head 52 has an exfoliating face 54 having a plurality of protrusions 53 disposed in a spaced apart relation about the exfoliating face 54, for exfoliating the dermis. An applicator face 56 is disposed on an opposite side of the head 52. The applicator face 56 is configured to apply a serum delivered through an aperture 68 in the applicator face 56. The head 52 is communicatively coupled to a reservoir 60 carried within a proximal end of the exfoliating applicator end 50 via a channel shaft 58.

The reservoir 60 is configured to contain a volume of a serum for delivery to the applicator face 56. A piston 62 is movably carried within the interior cavity of the reservoir 60. Activation of the serum delivery button 44 selectively extends the shaft 46 for engagement with a seat 48 on a back side of the piston 62 to urge the piston 62 for delivery of the serum carried within the reservoir 60.

The serum is delivered to the applicator face 56 via a channel 64 in a coupling end of the reservoir 60. The channel 64 is configured in fluid communication with an internal channel 66 of the head 52 and delivery to the applicator face 56 via the aperture 68. The head 52 is removably attached to the reservoir 60 via a coupling 65, which may be a snap fit or a threaded engagement.

Each of the head 52 and the reservoir 60 of the exfoliating applicator end 50 may be disposable elements. In the case of the head 52, it may be replaced after one or more uses for sanitary reasons. In the case of the reservoir 60, it may be replaced upon depletion of the quantity of serum contained therein. Alternatively, the serum may be contained within a replaceable cartridge reservoir 60. A frangible seal 69 is provided to contain the serum within the reservoir 60 until it is ready for dispensing.

The foregoing description of illustrated embodiments of the present invention, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. For example, it should be appreciated that other geometric shapes of the handle portion, such as for example, hexagonal, may be used to form the shapes of the unitary body, both the cylindrical longitudinal handle portion and the tapered portion of the applicator head.

It should be understood, of course, that the foregoing relates to exemplary embodiments of the invention and that modifications may be made without departing from the spirit and scope of the invention as set forth in the following claims.

What is claimed is:

1. An aesthetic applicator, comprising:

an elongate handle at a first end of the aesthetic applicator;

an exfoliating applicator end removably coupled in axial alignment with a second end of the elongate handle, the exfoliating applicator end having a reservoir defined by a sidewall of the exfoliating applicator end, and a channel at a distal end of the exfoliating applicator end in communication with the reservoir;

a head removably coupled with the distal end of the exfoliating applicator end, the head having an applicator face having a smooth surface configured to apply a topical skin nourishing serum to a dermis of a user's face and neck, an aperture defined in the applicator face communicatively coupled with the reservoir via an internal channel, and an exfoliating face having a plurality of protrusions disposed in a spaced apart relation about the exfoliating face, the plurality of protrusions configured for gentle exfoliation of the dermis of the user's face and neck, the exfoliating face disposed on an opposite side of the head from the applicator face; and the reservoir configured to contain a volume of the topical skin nourishing serum therein, the reservoir in fluid communication with the aperture of the applicator face via the channel and the internal channel.

2. The aesthetic applicator of claim 1, further comprising:

a piston moveably carried within the reservoir; and a shaft carried within the elongate handle and operable for urging the piston to dispense the topical skin nourishing serum from the reservoir to the applicator face.

3. The aesthetic applicator of claim 2, further comprising:

a coupling at the distal end of the exfoliating applicator end; and a channel shaft at a proximal end of the head, the channel shaft having an interior channel for communication of the topical skin nourishing serum to the applicator face.

4. The aesthetic applicator of claim 3, further comprising:

a cartridge containing a quantity of serum, the cartridge adapted to be received within the reservoir.

5. The aesthetic applicator of claim 4, further comprising:

a frangible seal disposed between the reservoir and the head, wherein the frangible seal may be ruptured by pressurization of the topical skin nourishing serum contained within the cartridge.

6. The aesthetic applicator of claim 1, wherein the applicator face is a sponge like material.

* * * * *